US007152512B1

(12) United States Patent
Prochaska

(10) Patent No.: US 7,152,512 B1
(45) Date of Patent: Dec. 26, 2006

(54) RAZOR HANDLE WITH SPRING FINGERS

(75) Inventor: Frank Prochaska, Waynesboro, VA (US)

(73) Assignee: American Safety Razor, Verona, VA (US)

( * ) Notice: Subject to any disclaimer, the term of this patent is extended or adjusted under 35 U.S.C. 154(b) by 50 days.

(21) Appl. No.: 10/418,318

(22) Filed: Apr. 18, 2003

Related U.S. Application Data

(60) Provisional application No. 60/373,318, filed on Apr. 18, 2002.

(51) Int. Cl.
*B26B 21/52* (2006.01)

(52) U.S. Cl. ..... 83/13; 30/527; 30/50

(58) Field of Classification Search ..... 30/531, 30/50, 57, 527; D28/48; 83/13
See application file for complete search history.

(56) References Cited

U.S. PATENT DOCUMENTS

| | | | | |
|---|---|---|---|---|
| 4,281,454 | A | 8/1981 | Trotta | |
| 4,282,651 | A | 8/1981 | Trotta | |
| 4,308,663 | A | 1/1982 | Ciaffone | |
| D266,960 | S | 11/1982 | Gray et al. | |
| 4,428,116 | A | 1/1984 | Chen et al. | |
| 4,453,310 | A | 6/1984 | Miserez | |
| 4,599,793 | A | 7/1986 | Iten | |
| D293,036 | S | 12/1987 | Iten et al. | |
| 4,797,998 | A | 1/1989 | Motta | |
| 4,837,930 | A * | 6/1989 | Righi | 30/47 |
| 5,157,834 | A | 10/1992 | Chen et al. | |
| 5,347,717 | A | 9/1994 | Ts'ai | |
| D365,419 | S | 12/1995 | Kamiya | |
| D393,330 | S | 4/1998 | Gray | |
| 5,784,790 | A | 7/1998 | Carson, III et al. | |
| D397,829 | S | 9/1998 | Gray | |
| D397,830 | S | 9/1998 | Gray | |
| D398,718 | S | 9/1998 | Gray | |
| 5,813,119 | A | 9/1998 | Ferraro et al. | |
| 5,855,071 | A | 1/1999 | Apprille, Jr. et al. | |
| D413,181 | S | 8/1999 | Yamagishi | |
| 5,953,824 | A | 9/1999 | Ferraro et al. | |
| D416,109 | S | 11/1999 | Wonderley | |
| D419,265 | S | 1/2000 | Gray | |
| 6,029,354 | A | 2/2000 | Apprille, Jr. et al. | |
| 6,115,924 | A | 9/2000 | Oldroyd | |
| 6,138,361 | A | 10/2000 | Richard et al. | |
| 6,192,586 | B1 | 2/2001 | Metcalf et al. | |
| D441,910 | S | 5/2001 | Prochaska | |
| D445,958 | S | 7/2001 | Dansreau et al. | |
| D467,388 | S * | 12/2002 | Prochaska et al. | D28/48 |

FOREIGN PATENT DOCUMENTS

| | | |
|---|---|---|
| EP | 0 321 883 A1 | 6/1989 |
| WO | WO 96/29183 | 9/1996 |
| WO | WO 97/26119 | 7/1997 |
| WO | WO 99/04938 | 2/1999 |

* cited by examiner

*Primary Examiner*—Charles Goodman
(74) *Attorney, Agent, or Firm*—McDermott Will & Emery LLP

(57) ABSTRACT

A shaving system comprising a razor handle having a razor cartridge pivotally connected thereto, the normal shaving process causing the razor cartridge to be pivoted to a first, upwardly pivoted, position and a second, downwardly pivoted, position, the razor handle comprising flexible spring fingers extending toward each other having cam followers for engaging a cam surface on an underside of the razor cartridge, the cam followers providing a biasing force on the cam surface such that the pivoted cartridge is returned to a neutral position.

25 Claims, 12 Drawing Sheets

RAZOR HANDLE WITH SPRING FINGERS

RELATED APPLICATION

This application claims the benefit of U.S. Provisional Patent Application Ser. No. 60/373,318 entitled "Razor Handle With Cantilevered Spring Fingers" invented by Frank Prochaska filed, Apr. 18, 2002, which is incorporated herein by reference.

FIELD OF THE INVENTION

The present invention relates to a shaving system. The present invention has particular applicability to razor handle and cartridge configured to permit pivotal rotation of a razor cartridge utilizing spring fingers to return the cartridge from a pivoted position to a neutral position.

BACKGROUND ART

Many conventional shaving razor handle heads are configured to permit rotation of a razor cartridge about a pivot point. Some arrangements permit free rotation of the razor cartridge through a predetermined range about pins attached to the head and engaging an underside of the razor cartridge. Other types include arcuate bearings formed in the handle head, which mate with hooks on the underside of the razor cartridge. The arcuate bearings determine the range of pivoting motion of the cartridge. Some handle heads spring-load or bias the pivotally mounted razor cartridge toward a neutral position, such as at or near the midpoint of the predetermined range, allowing the cartridge to be displaced away from the neutral position in one direction, and to then move back to the neutral position using complicated spring configurations or requiring unique or specialized razor cartridges. Thus, there is a need for a simplified, inexpensive razor cartridge biasing device that can be used with a conventional razor cartridge.

SUMMARY OF THE INVENTION

The present invention uses spring fingers to bias a pivoted razor cartridge back to a neutral position. The spring fingers, which have cam followers on each end, extend from the arms of the razor handle towards the middle of the handle to contact a cam surface of the cartridge. The spring fingers are molded integrally with the handle. Since they are separate from each other, they do not interfere with one another in operation.

According to the present invention, the foregoing and other advantages are achieved in part by a razor cartridge biasing device for a razor handle, comprising a razor handle having a pair of opposing arms extending from the handle head, distal portions of the arms comprising connectors to which a razor cartridge can be pivoltally connected; a first spring finger extending from one of the arms towards the other arm; a second spring finger extending from the other arm toward the first spring finger; each spring finger having a cam follower attached. One cam follower engages one portion of a cam located on the razor cartridge when the cartridge is pivoted in the upward direction during the normal course of shaving, thus urging the cartridge back to a neutral position. The other cam follower engages another portion of the same cam when it is pivoted in the downward direction, thus urging it back to the same neutral position.

Additional advantages of the present invention will become readily apparent to those skilled in this art from the following detailed description, wherein only the preferred embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DESCRIPTION OF THE INVENTION

In accord with the present invention, a razor handle is integrated with spring fingers which bias an attached razor cartridge toward a neutral position from either a first, upwardly pivoted, position, or a second, downwardly pivoted, position. In a one embodiment, the spring fingers of the present invention are angled to provide centering of the cartridge (i.e., displacement toward a neutral position) by imparting upon the razor cartridge a multi-dimensional force component (i.e., a direction that is not exclusively along a normal direction to the arcuate rails), thereby increasing the friction in the pivot.

As shown in one embodiment in FIGS. 1–4, razor handle 10 is provided with two outwardly protruding arms 10*a* and 10*b*. Arms 10*a* and 10*b* include connectors 20*a* and 20*b*, respectively, to which underside 75*b* of razor cartridge 75 may be connected. As illustrated, arms 10*a* and 10*b* also comprise retention collars 13*a* and 13*b*, respectively, on which corresponding surfaces of underside 75*b* of razor cartridge 75 may slide. Spring fingers 40*a* and 40*b* extend inwardly toward longitudinal center line 45 from arms 10*a* and 10*b*, respectively, (see FIG. 4).

Figure 1:
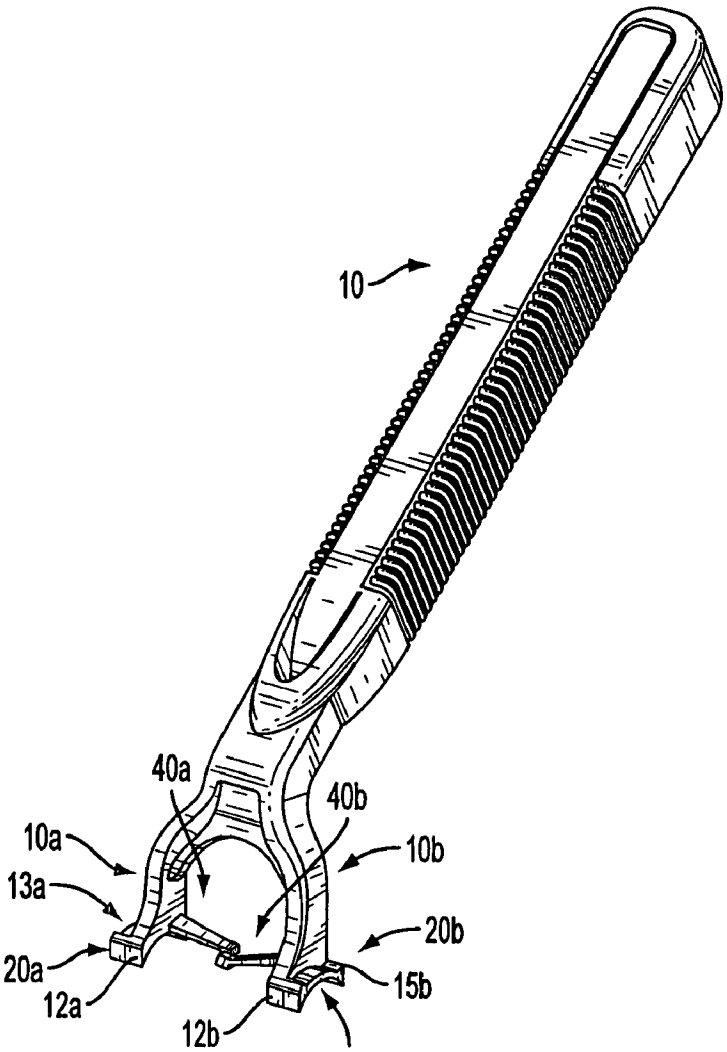
FIG. 1 is a perspective view of a razor handle having spring fingers in accord with the invention.
Figure 2:
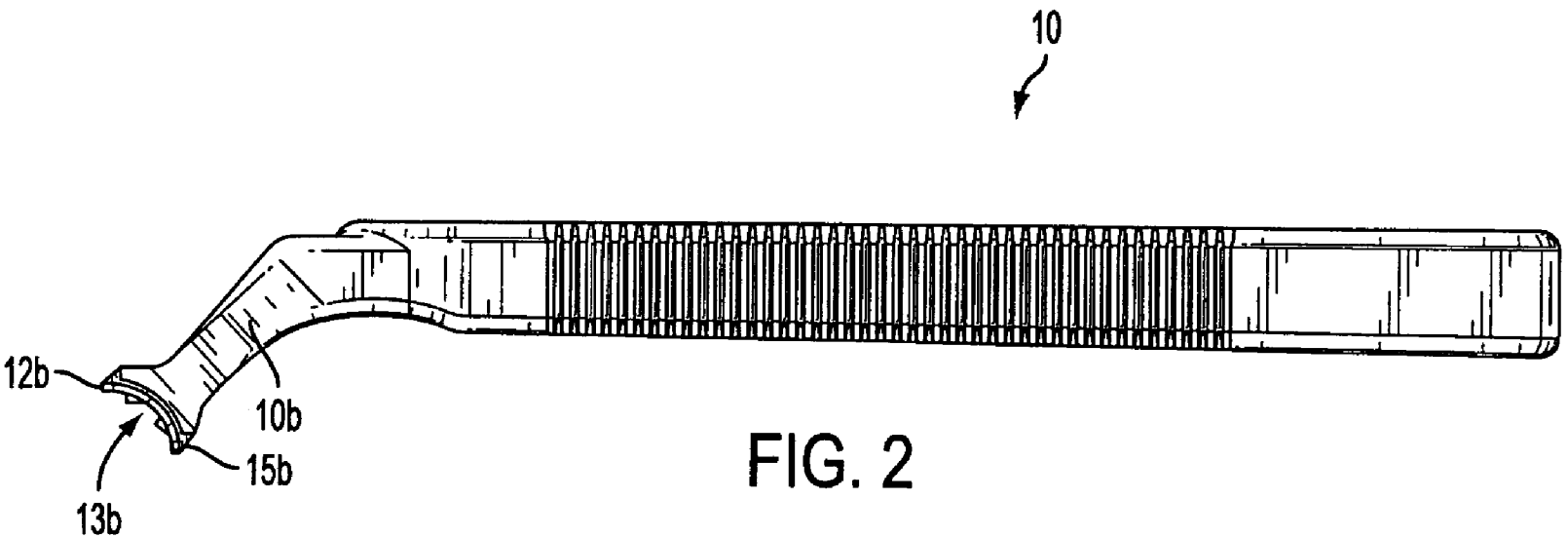
FIG. 2 is a side view of a razor handle having spring fingers in accord with the invention.
Figure 3:
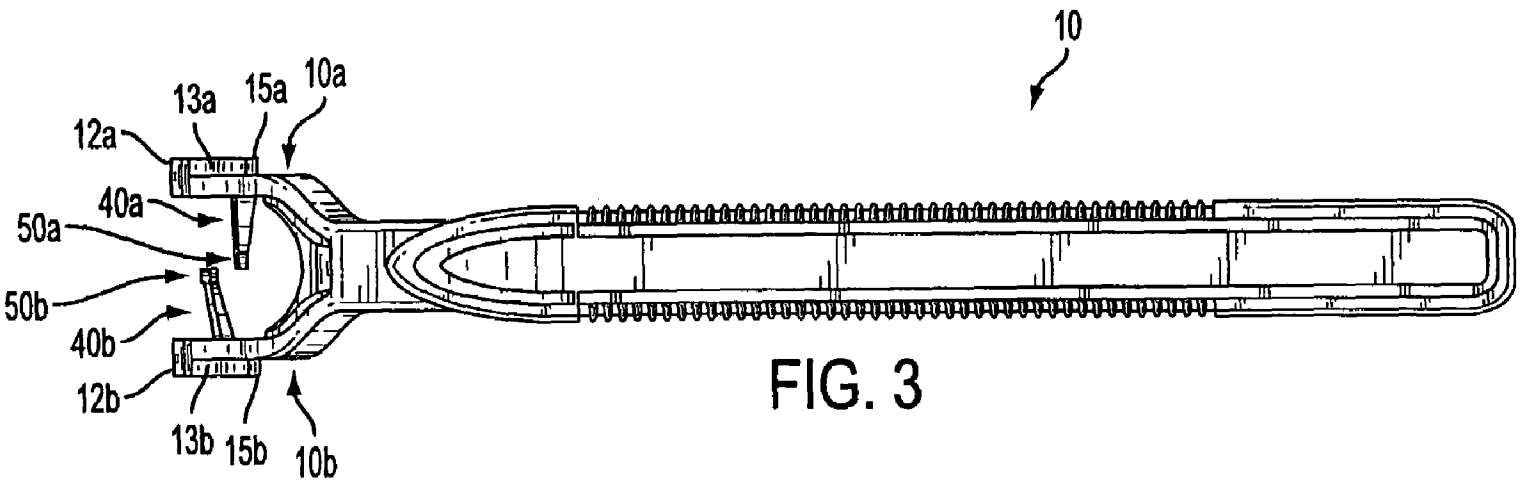
FIG. 3 is a top view of a razor handle having spring fingers in accord with the invention.
Figure 4:
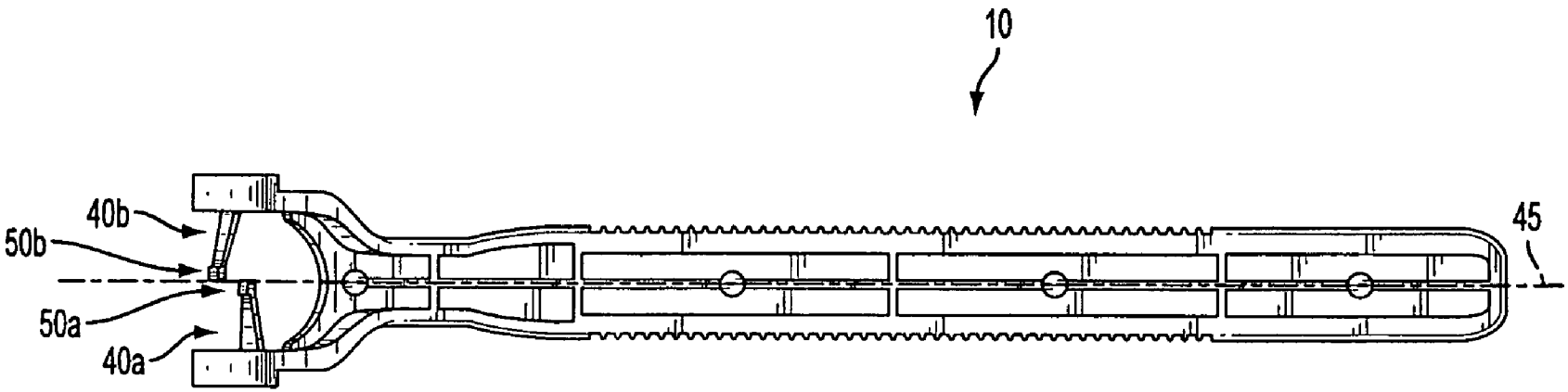
FIG. 4 is a bottom view of a razor handle having spring fingers in accord with the invention.

Spring fingers 40*a* and 40*b* extend away from arms 10*a* and 10*b*, respectively. In this embodiment, spring fingers 40*a* and 40*b* are slightly angled, (best shown in FIGS. 3 and 4) and are formed as integral parts of arms 10*a* and 10*b*. Alternatively, spring fingers 40*a* and 40*b* may be added as separate components during the manufacturing process. As shown in FIGS. 1, 3, and 4, spring fingers 40*a* and 40*b* are splayed from one another and are not coaxial.

Spring fingers 40*a* and 40*b* also include spring finger heads 50*a* and 50*b*, respectively, and are disposed at a distal end of each spring finger 40*a* and 40*b*. Spring finger heads 50*a* and 50*b* are generally box-like (e.g., about 0.040"× 0.040"×0.050"), and possess a slightly angled or curved surface (e.g., 0.0150" radius) on a face opposing a position to be ultimate occupied by a corresponding cam surface on underside 75*b* of razor cartridge 75. Those skilled in the art would appreciate that the shape of spring finger heads 50*a* and 50*b* is not limited to a box, but can be any shape that would maximize the biasing force on cam surfaces 70*a* and 70*b* as described later herein. Spring finger heads 50*a* and 50*b* are positioned to straddle center line 45 of razor handle 10 along longitudinal axis 45 as shown in FIG. 4.

Razor handle 10 also includes arms 10*a* and 10 that include connectors 20*a* and 20*b*, respectively, as shown generally in FIGS. 1–4 and in detail in FIGS. 5A–7B. Connectors 20*a* and 20*b* are identical in construction. Connectors 20*a* and 20*b* include retention collars 13*a* and 13*b* having rear surfaces 11*a* and 11*b* and front surfaces 14*a* and 14*b*, best shown in FIGS. 5A–7B. Connectors 20*a* and 20*b* are formed as integral parts of arms 10*a* and 10*b*. Retention collars 13*a* and 13*b* are bounded by upper mechanical stops 12*a* and 12*b* and lower mechanical stops 15*a* and 15*b*. For connector 20*a*, rear surface 11*a*, upper mechanical stop 12*a*, and lower mechanical stop 15*a* combine to form a closed path to allow retention hook 78*a* to travel therein as described in further detail below. Similarly, for connector 20*b*, rear surface 11*b*, upper mechanical stop 12*b*, and lower mechanical stop 15*b* combine to form a closed path to allow retention hook 78*b* to travel therein as further described below.

The shaving system of the present invention includes razor cartridge 75 having a topside 75*a* and an underside 75*b*. Topside 75*a* is a conventional razor cartridge design which includes such standard features as soap bar 84, razor blades 86, and guard member 88. Underside 75*b* includes cam 71, retention struts 76*a* and 76*b*, and pivot ridges 77*a* and 77*b*.

Cartridge 75 includes cam 71, best shown in FIGS. 5A–7B. Cam 71 is located at the center of the length of cartridge 75 and spans at least a portion of the width of underside 75*b* of cartridge 75. Cam 71 includes lower portion 71*a*, center portion 71*b*, and upper portion 71*c*. Center portion 71*b* of cam 71 is of reduced thickness with respect to lower and upper portions 71*a* and 71*b*, shown best in FIGS. 5B, 6B, and 7B. While shown as a "V" configuration in FIG. 5B, cam 71 can be a convex or other configuration, best designed to provide a biasing force when used with cam followers, previously described as spring finger heads 50*a* and 50*b*. Cam 71 also includes cam surfaces 70*a* and 70*b* that correspond to lower and upper cam portions 71*a* and 71*b*. In one embodiment, cam 71 is a "V" configuration having vertex 80. In such a configuration cam surfaces 70*a* and 70*b* are flat. However, in an alternate embodiment (not shown), cam 71 may be a convex configuration, among others, making cam surfaces 70*a* and 70*b* curved and eliminating vertex 80 altogether.

Figure 5A:
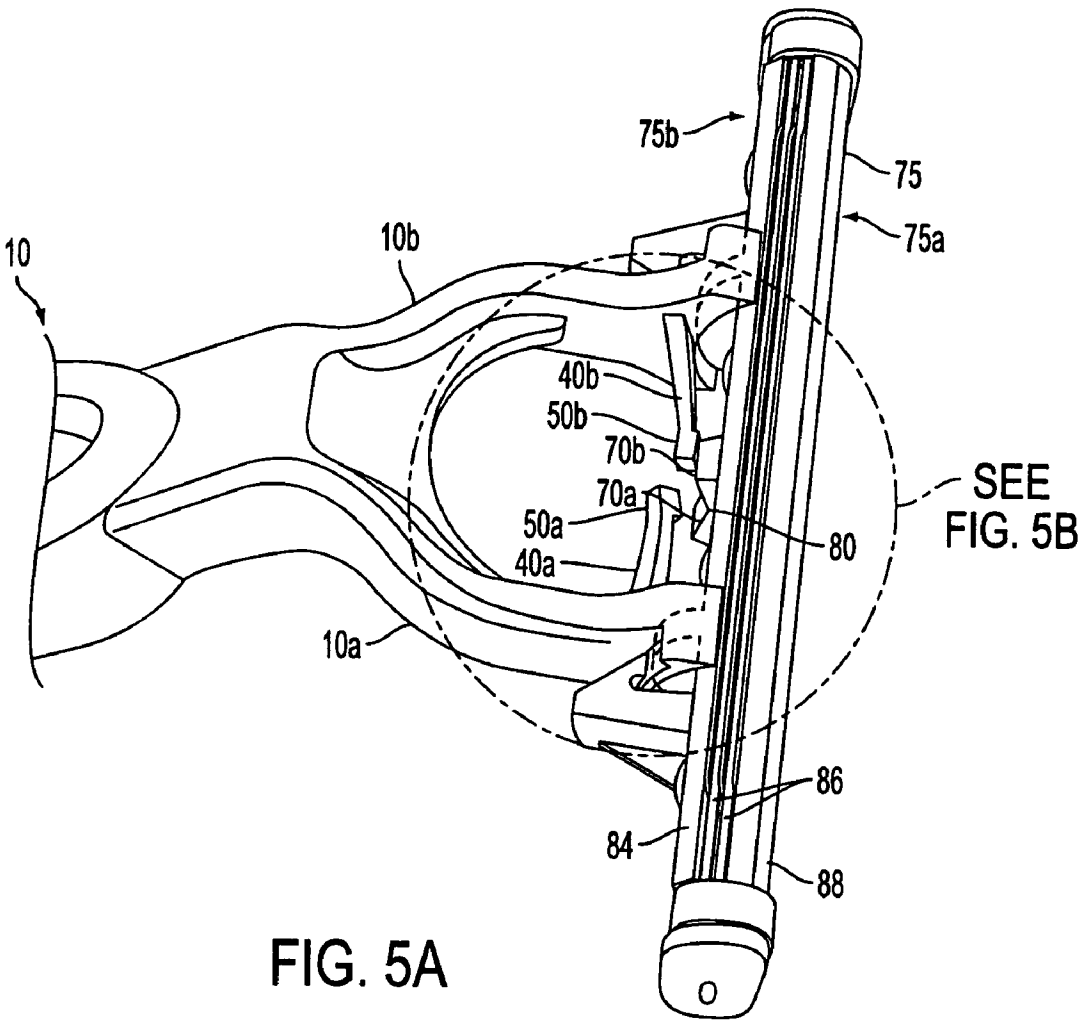
FIG. 5A is a perspective view of a shaving system having spring fingers in accord with the invention with the cartridge in the first, upwardly pivoted, position.
Figure 5B:
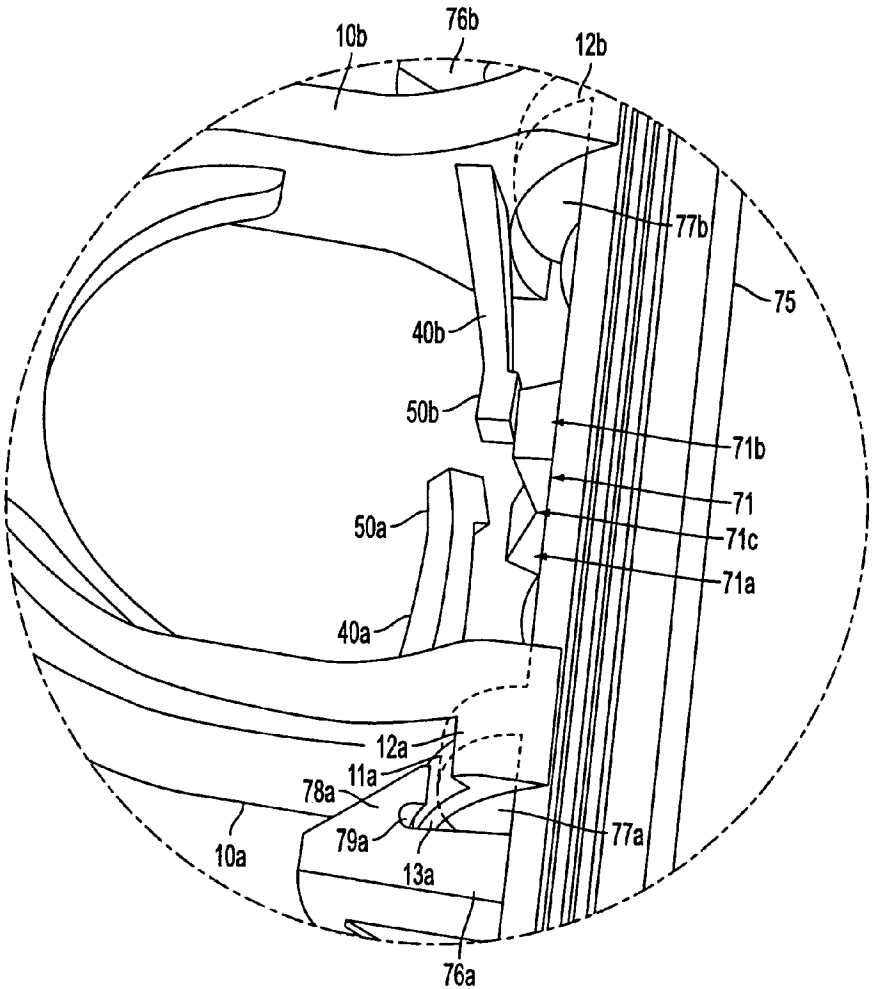
FIG. 5B is a enlarged partial view of a shaving system having spring fingers in accord with the invention as shown in FIG. 5A.
Figure 6A:
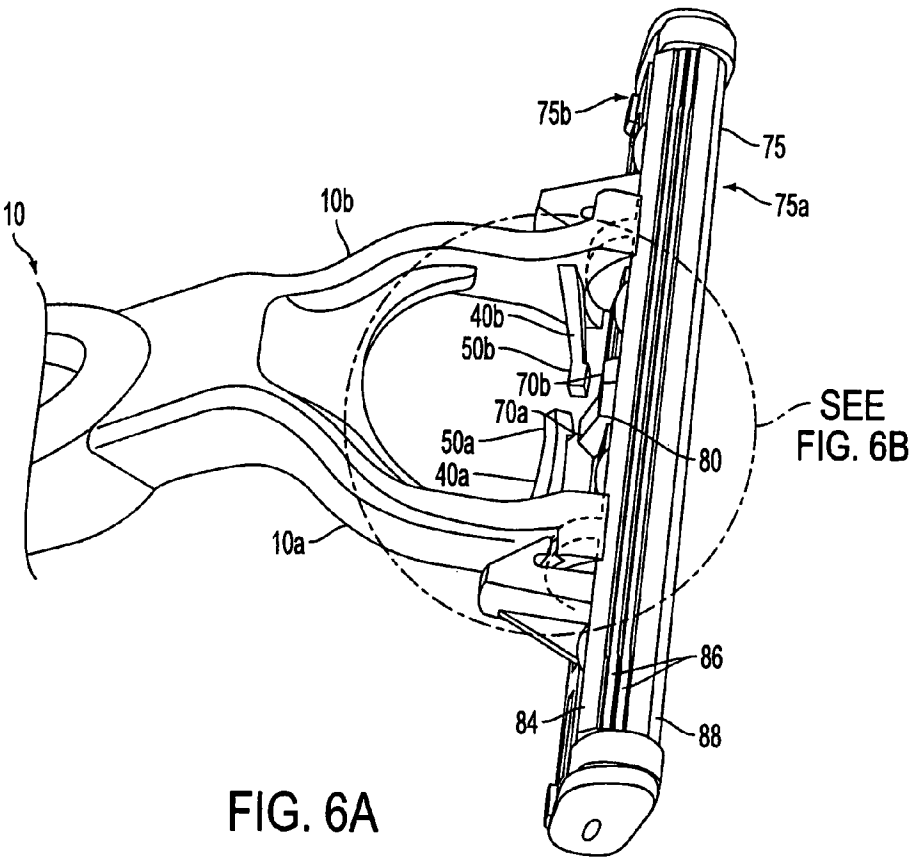
FIG. 6A is a perspective view of a shaving system having spring fingers in accord with the invention with the cartridge in the neutral position.
Figure 6B:
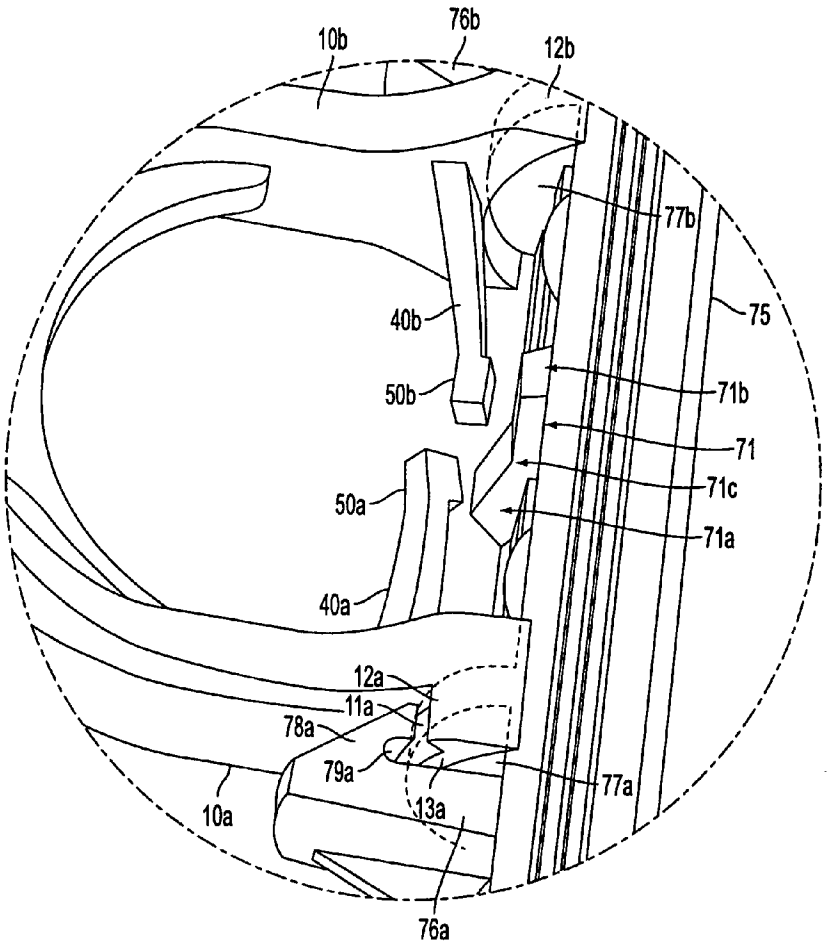
FIG. 6B is a enlarged partial view of a shaving system having spring fingers in accord with the invention as shown in FIG. 6A.
Figure 7A:
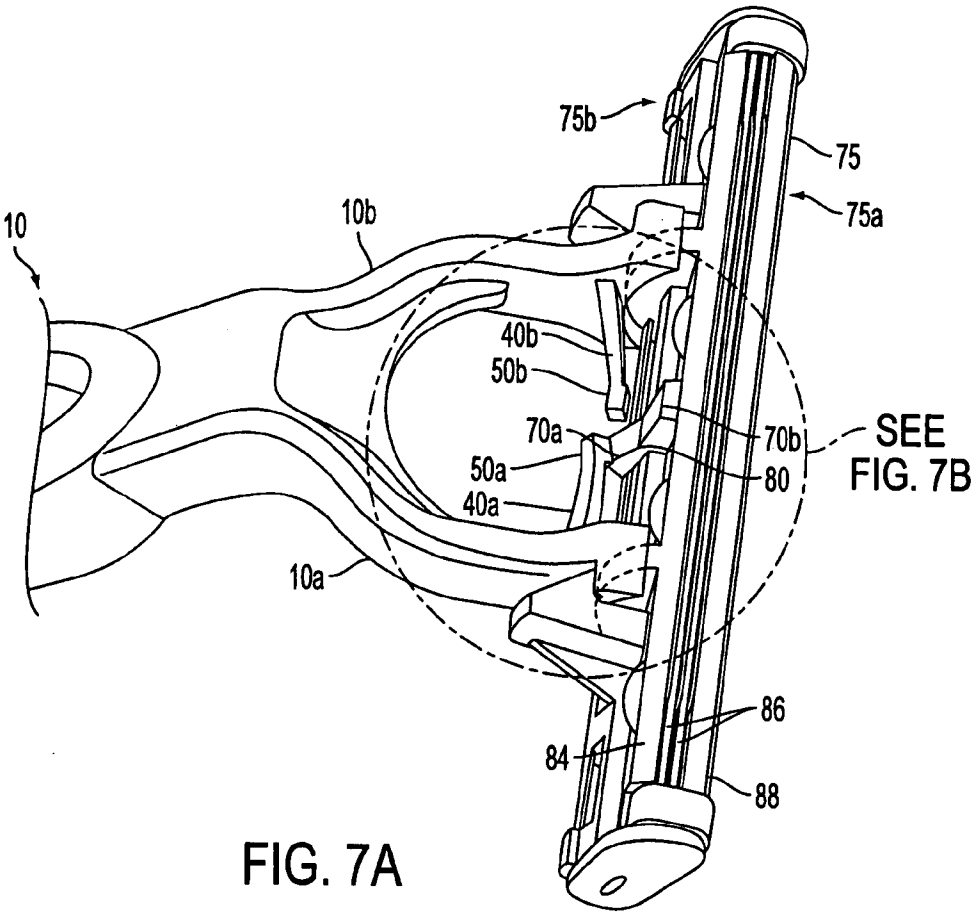
FIG. 7A is a perspective view of a shaving system having spring fingers in accord with the invention with the cartridge in the second, downwardly pivoted, position.
Figure 7B:
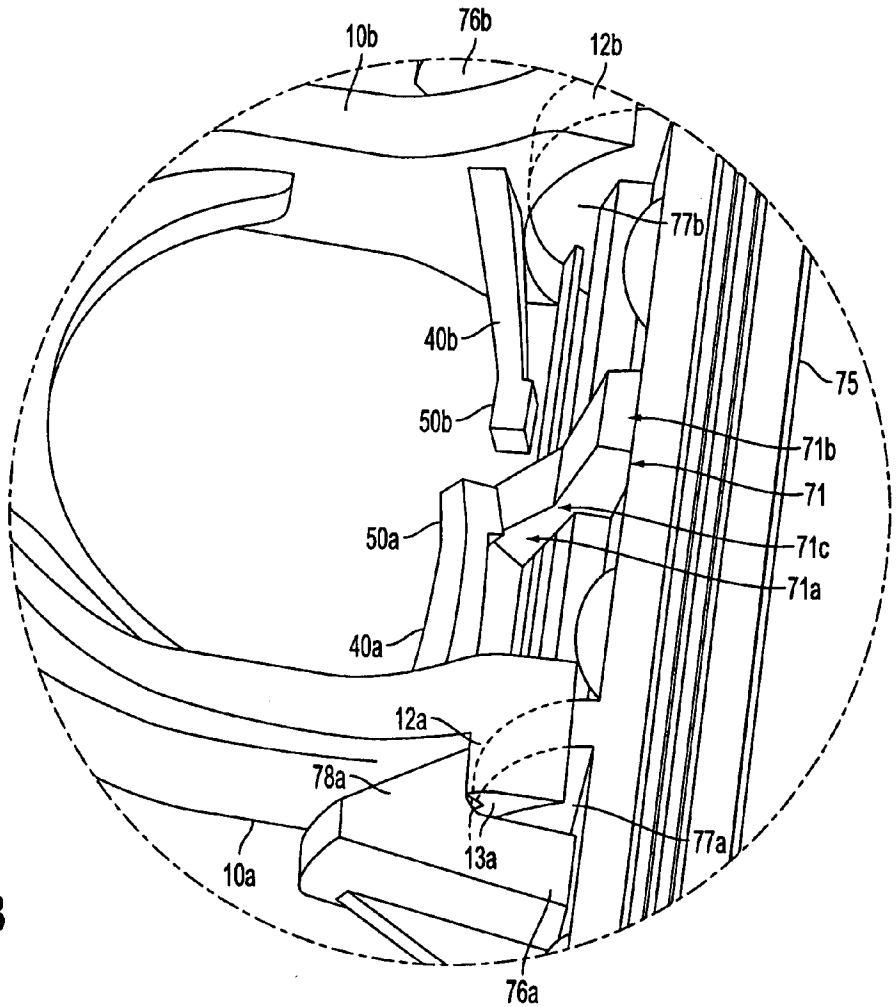
FIG. 7B is a enlarged partial view of a shaving system having spring fingers in accord with the invention as shown in FIG. 7A.
Figure 8A:
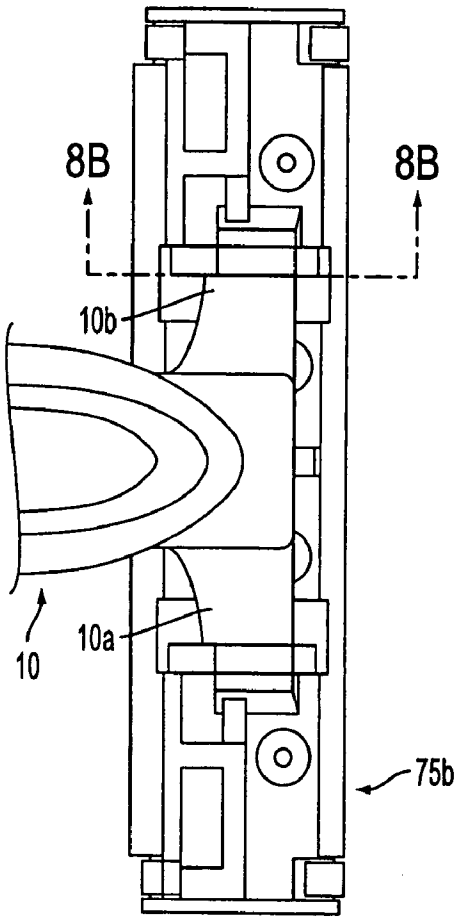
FIG. 8A is a rear view of a shaving system having spring fingers in accord with the invention.
Figure 8B:
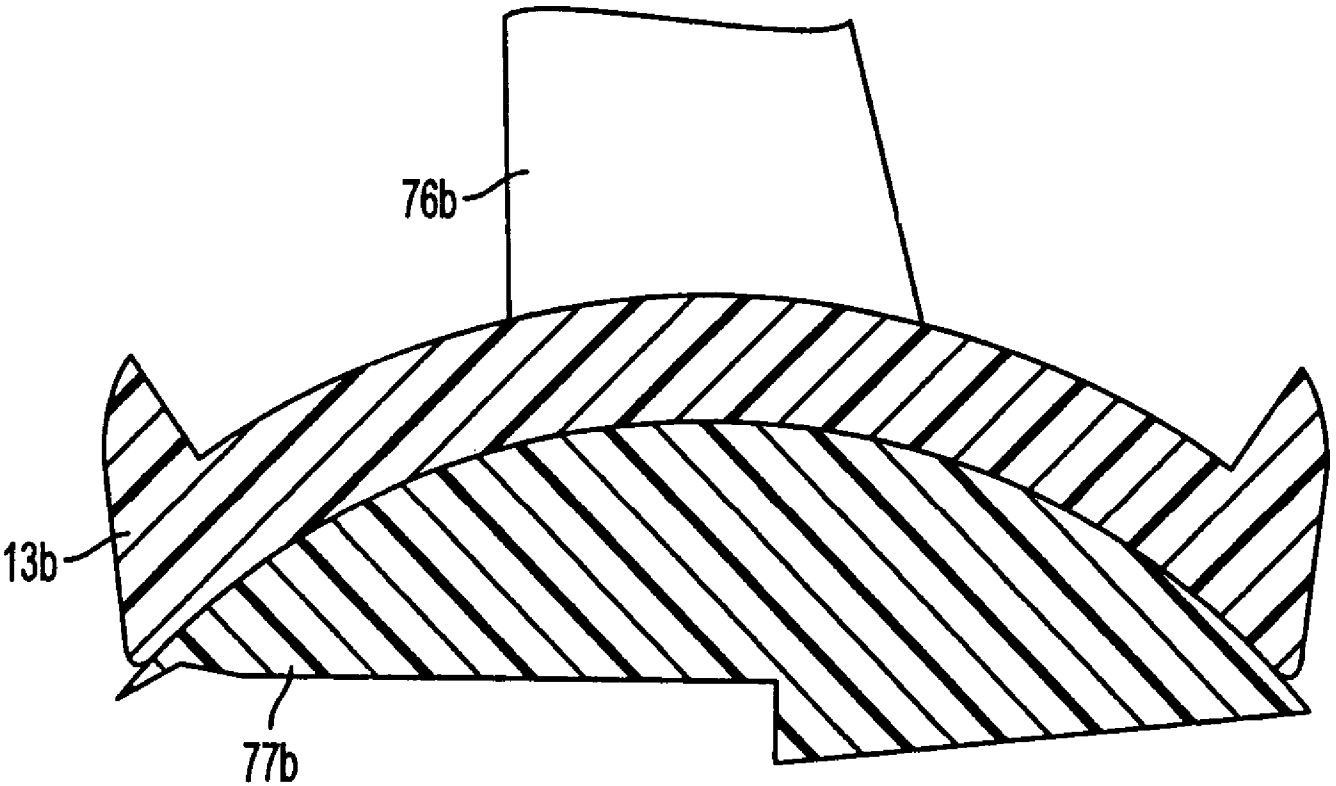
FIG. 8B is a cross-sectional view of a shaving system having spring fingers in accord with the invention taken through line 8B—8B of FIG. 7B.

Cartridge 75 also includes pivot ridges 77*a* and 77*b*, shown in FIGS. 5A, 6B, and 7B, but best shown in FIG. 8B. Pivot ridges 77*a* and 77*b* are convex surfaces are located on underside 75*b* of cartridge 75 and in one embodiment of the present invention preferably are positioned such that they approximately divide the length of cartridge 75 into thirds. Pivot ridges 77*a* and 77*b* are illustrated as being formed as an integral part of cartridge 75 but in the alternative may be added separately during the assembly process and may be made of any suitable material. Pivot ridges 77*a* and 77*b* generally span the width of underside 75*b* of cartridge 75 as shown in FIGS. 5A–7B.

Razor cartridge 75 also includes retention struts 76*a* and 76*b* that extend away from and generally perpendicular to underside 76*b* of cartridge 75, best shown in FIGS. 5A–7B. Retention struts 76*a* and 76*b* are located along the length of cartridge 75 closer to the ends than are pivot ridges 77*a* and 77*b*. The exact spacing is a chosen such that retention struts 76*a* and 76*b* cooperate with connectors 20 located on razor handle 10, the operation of which is discussed in detail below. Retention struts 76*a* and 76*b* are formed as an integral part of cartridge 75 according to one embodiment of the invention but in the alternative can be added separately during the assembly process and may be made of any suitable material. Formed on retention struts 76*a* and 76*b* are retention hooks 78*a* and 78*b*, respectively. Retention hooks 78*a* and 78*b* are projections formed back towards underside 75*b* of cartridge 75 at an angle resembling a "check mark" or hook when viewed along the plane of cartridge 75, best shown in FIGS. 5A–7B. Retention strut 76*a*, retention hook 78*a*, and pivot ridge 77*a* combine to define retention slot 14*a* on one end of cartridge 75. Similarly, retention strut 76*b*, retention hook 78*b*, and pivot ridge 77*b* combine to define retention slot 14*b* on the other end of cartridge 75.

The present invention includes a shaving system having cartridge 75 with the ability to pivot through a range of motion from a first, upwardly pivoted, position, shown in FIG. 5A, through a second, neutral position, shown in FIG. 6A, to a third, downwardly pivoted, position, shown in FIG. 7A. Of course, the first and third positions represent the extreme pivoted positions; cartridge 75 may pivot up or down to a lesser extent as the cartridge conforms to the contours of the user's face during the shaving process.

FIGS. 5A and 5B depict razor cartridge 75 in the first, upwardly pivoted, position. Forces during the normal course of shaving, such as the contours of the user's face, may cause cartridge 75 to pivot in the upward direction. Cartridge 75 pivots on handle 10 on several of its surfaces. Pivot ridges 77*a* and 77*b* of cartridge 75 slidably engage front surfaces 14*a* and 14*b* of retention collars 13*a* and 13*b*, respectively, best shown in FIG. 5B. Furthermore, retention hook 78*a* rides against rear surface 11*a* of retention collar 13*a* and the corresponding retention hook (not shown) engages the corresponding rear surface (not shown) for retention collar 13*b*. As cartridge 75 pivots upward, the travel of retention hook 78*a* is limited by lower mechanical stop 15*a*. Similarly, the travel of retention hook 78*b* is limited by lower mechanical stop 15*b*. Also, retention collar 13*a* engages slot 79*a* on one side of handle 10, as does the corresponding rail (not shown) engage the corresponding slot on arm 10*b* on the other side of handle 10. As cartridge 75 pivots upward, spring heads 50*a* and 50*b* contact respective cam surfaces 70*a* and 70*b* of razor cartridge 75. In the exemplary embodiment of the present invention, cam surfaces 70*a* and 70*b* are different surfaces of cam 71 and are oppositely inclined about center point 80, shown in FIG. 5B.

When the forces on shaving cartridge 75, such as the current contours of the user's face, are relieved, spring finger head 50*b* acts as a cam follower with respect to cam portion 70*b* and exerts a biasing force thereon, thus urging cartridge 75 back to a neutral position, as shown in FIGS. 6A and 6B.

FIGS. 6A and 6B show cartridge 75 in the second, neutral, position. Spring finger heads 50*a* and 50*b* either do not contact respective cam surfaces 70*a* and 70*b* or do not exert any appreciable centering force thereon. Thus, near the neutral position, centering forces are negligible.

FIGS. 7A and 7B depict cartridge 75 in the third, downwardly pivoted, position. Forces similar to those that cause cartridge 75 to pivot in the upward direction, previously described, may also cause cartridge 75 to pivot in the downward direction. As such, the pivoting mechanism of cartridge 75 with respect to handle 10 is the same. Pivot ridges 77*a* and 77*b* of cartridge 75 slidably engage front surfaces 14*a* and 14*b* of retention collars 13*a* and 13*b*, respectively, best shown in FIG. 7B. Furthermore, retention hook 78*a* rides against rear surface 11*a* of retention collar 13*a* and the corresponding retention hook (not shown) engages the corresponding rear surface (not shown) for retention collar 13*b*. As cartridge 75 pivots downward, the travel of retention hook 78*a* is limited by upper mechanical stop 12*a*. Similarly, the travel of retention hook 78*b* is limited by upper mechanical stop 12*b*. Also, retention collar 13*a* engages slot 79*a* on one side of handle 10, as does the corresponding rail (not shown) engage the corresponding slot 79*b* on arm 10*b* on the other side of handle 10. As cartridge 75 pivots downward, spring head 50*a* contacts cam surface 70*a* of razor cartridge 75. In the embodiment depicted, cam surfaces 70*a* and 70*b* are different surfaces of cam 71 and are oppositely inclined about center point 80, shown in FIG. 5B.

When the forces on shaving cartridge 75, such as the current contours of the user's face, are relieved, spring finger head 50*a* acts as a cam follower with respect to cam portion 70*a* and exerts a biasing force thereon, thus urging cartridge 75 back to a neutral position, as shown in FIGS. 7A and 7B.

Additional advantages of the present invention will become readily apparent to those skilled in this art from the detailed description herein, wherein only exemplary embodiments of the present invention are shown and described by way of illustration of the best mode or modes contemplated for carrying out the present invention. As will be realized, the present invention is capable of other and different embodiments, and its details are capable of modifications in various obvious respects, all without departing from the concept of the disclosed invention. Accordingly, the drawings and description are to be regarded as merely illustrative in nature, and are not to be regarded as limiting or restrictive on the broad aspects of the invention provided herein.

What is claimed is:

1. A method of biasing a razor cartridge to a neutral position, said method comprising the steps of:

applying a biasing force to a single cam on said razor cartridge in a first pivoted position using a first cam follower on a first flexible spring finger, and applying a biasing force to said cam on said razor cartridge in a second pivoted position using a second cam follower on a second flexible spring finger.

2. The method of claim 1 further comprising the step of maximizing said biasing force on said cam on said razor cartridge in a first pivoted position by providing said first cam follower having an optimum shape.

3. The method of claim 1 further comprising the step of maximizing said biasing force on said cam on said razor cartridge in a second pivoted position by providing said second cam follower having an optimum shape.

4. A razor cartridge biasing device for a razor handle comprising, a pair of opposed outwardly protruding arms, said arms each having a distal end for pivotally connecting to razor cartridge;

a first spring finger extending inwardly from proximal the distal end of one of said arms;

a second spring finger extending inwardly from proximal the distal end of another of said arms, wherein said first spring finger is configured to contact an underside of said cartridge to impart a clockwise biasing force, relative to a center of pivot action of said razor cartridge, to the underside of said cartridge, upon a counter-clockwise movement of said cartridge from a neutral position of said cartridge, wherein said second spring finger is configured to contact an underside of said cartridge to impart a counter-clockwise biasing force, relative to a center of pivot action of said razor cartridge, to the underside of said cartridge upon a clockwise movement of the cartridge from a neutral position of the cartridge;

wherein said first and second spring fingers are for imparting said biasing forces to a single cam surface disposed generally on a central region of said underside of said cartridge.

5. The razor cartridge biasing device of claim 4 wherein said arms further comprise first and second connectors, said first and second connectors having distal portions bearing first and second retention collars, respectively.

6. The razor cartridge biasing device of claim 4 wherein said first and second spring fingers are for imparting said biasing forces to a V-shaped cam surfaced disposed generally on a central region of said underside of said cartridge.

7. The razor biasing device of claim 6 wherein said V-shaped cam surface comprises two portions, each portion having a relatively flat surface.

8. The razor cartridge biasing device of claim 4 wherein said first and second spring fingers are for imparting said biasing forces to a convex-shaped cam surfaced disposed generally on a central region of said underside of said cartridge.

9. The razor cartridge biasing device of claim 4 wherein said first and second spring fingers further comprise first and second cam followers, respectively.

10. The razor cartridge biasing device of claim 9 wherein said first and second cam followers are box-like in shape.

11. A shaving system, comprising, a razor cartridge, said cartridge comprising, a top side, said top side comprising a plurality of blades, an underside, said underside comprising a first and second connector, said first and second connector being spaced apart from one another, said underside further comprising a cam, said cam disposed on said underside between said first and second connectors, said cam having a center portion, an upper portion and a lower portion, said center portion having a reduced thickness with respect to said upper and lower portions, a razor handle, said handle comprising, a first arm, said first arm engaging said first connector of said razor cartridge, said first arm further comprising a first spring finger having a first cam follower, wherein said first cam follower engages said lower portion of said cam surface when said cartridge is in a first position, a second arm, said second arm engaging said second connector of said razor cartridge, said second arm further comprising a second spring finger having a second cam follower, wherein said second cam follower engages said upper portion of said cam surface when said cartridge is in a second position.

12. The shaving system of claim 11 wherein said first spring finger extends inwardly from and generally transverse to said first arm of said razor handle and said second spring finger extends inwardly from and generally transverse to said second arm of said razor handle.

13. The shaving system of claim 11 wherein said first spring finger is not coaxial with said second spring finger.

14. The shaving system of claim 11 wherein said first and said second spring finger are disposed such that together they are positionally bisected by a longitudinal axis of said razor handle.

15. The shaving system of claim 11 wherein said cartridge further comprises a first and second retention ridge and wherein said first and second arms further comprise first and second retention collars, respectively, wherein said first retention ridge of said cartridge pivotally engages said first retention collar of said first arm and said second ridge of said cartridge pivotally engages said second collar of said second arm.

16. The shaving system of claim 15 wherein said first and second retention collars further comprise first and second upper and lower mechanical stops, respectively.

17. A shaving system comprising:

a razor cartridge, said razor cartridge having a top side and an underside, said razor cartridge having a first and a second cartridge connector being disposed on said underside of said razor cartridge, said razor cartridge further comprising a cam surface also disposed on said underside of said razor cartridge, said cam surface having a center portion, an upper portion, and a lower portion, said center portion being of a reduced thickness with respect to said upper and lower portions, a razor handle, said razor handle having a first handle connector and a second handle connector, said first handle connector being pivotally connected to said first cartridge connector and said second handle connector being pivotally connected to said second cartridge connector, said razor handle further comprising a first spring finger and a second spring finger, said first and second spring fingers having first and second cam followers, respectively, wherein said first cam follower is engaged with said upper portion of said cam surface when said cartridge is in a first pivoted position, said first cam follower urging said cartridge to a neutral position from said first pivoted position, and wherein said second cam follower is engaged with said lower portion of said cam surface when said cartridge is in a second pivoted position, said second cam follower urging said cartridge to a neutral position from said second pivoted position.

18. The shaving systems of claim 17 wherein said first and second cartridge connectors comprise first and second retention hooks, respectively, said first and second retention hooks extending away from and generally perpendicular to said underside of said razor cartridge.

19. The shaving system of claim 17 further comprising a first and second retention ridge, said first and second retention ridge being disposed along the length of said cartridge and spanning at least a portion of the width of said underside of said razor cartridge.

20. The shaving system of claim 17 wherein said first and second handle connectors comprise first and second retention collars, said first and second retention collars slidably engaging said first and second retention ridges, respectively.

21. The shaving system of claim 17 wherein said cam surface is generally disposed in the center area of said underside of said cartridge.

22. The shaving system of claim 17 wherein said cam surface comprises a V-shaped configuration.

23. The shaving system of claim 22 wherein said cam surface comprises two portions, said two portions having generally flat surfaces.

24. The shaving system of claim 17 wherein said cam surface comprises a convex configuration.

25. The shaving system of claim 17 wherein said first and second cam followers have a box-like configuration.

* * * * *